US005551950A

United States Patent [19]

Oppen

[11] Patent Number: 5,551,950

[45] Date of Patent: Sep. 3, 1996

[54] REHABILITATION METHOD

[76] Inventor: Peter Oppen, 10 Sassafras Rd., Westford, Mass. 01886

[21] Appl. No.: 88,790

[22] Filed: Jul. 8, 1993

[51] Int. Cl.[6] ..... A61H 1/00

[52] U.S. Cl. ..... 601/35; 482/131; 128/882

[58] Field of Search ..... 602/12, 29, 38; 128/25 R, 25 B, 876, 878, 882; 482/23, 79, 91, 145, 131; 434/247, 255; 601/33–35

[56] References Cited

U.S. PATENT DOCUMENTS

| | | | |
|---|---|---|---|
| 1,124,596 | 1/1915 | Dalpe | 607/29 |
| 1,530,519 | 3/1925 | Remington . | |
| 1,548,771 | 8/1925 | Townsend . | |
| 1,854,392 | 4/1932 | Bambrick . | |
| 1,909,002 | 5/1933 | Oehlberg . | |
| 2,200,407 | 5/1940 | Anderson | 602/38 |
| 2,214,052 | 9/1940 | Goud | 982/105 |
| 2,607,340 | 8/1952 | Anderson | 601/34 |
| 2,630,801 | 3/1953 | Mest et al. . | |
| 2,754,121 | 7/1956 | Jupiter . | |
| 2,760,774 | 8/1956 | Perez . | |
| 2,847,991 | 8/1958 | Andrews . | |
| 2,906,261 | 9/1959 | Craig . | |
| 2,966,905 | 1/1961 | Kamenshine . | |
| 3,171,407 | 3/1965 | Rogers | 602/29 |
| 3,308,829 | 3/1967 | Edwards . | |
| 3,750,659 | 8/1973 | Loomans . | |
| 3,805,773 | 4/1974 | Sichau . | |
| 3,892,230 | 7/1975 | Baker et al. | 601/33 |
| 3,911,907 | 10/1975 | Smith, Jr. . | |
| 3,955,565 | 5/1976 | Johnson, Jr. | 602/12 |
| 3,970,316 | 7/1976 | Westmoreland, Jr. | 128/878 |
| 4,089,330 | 5/1978 | Nicolosi et al. . | |
| 4,172,453 | 10/1979 | Leckie | 128/876 |
| 4,239,228 | 12/1980 | Norman et al. | 273/189 R |
| 4,252,112 | 2/1981 | Joyce . | |
| 4,258,445 | 3/1981 | Zur . | |
| 4,550,908 | 11/1985 | Dixon . | |
| 4,569,336 | 2/1986 | Wheeler . | |
| 4,599,996 | 7/1986 | Seith et al. . | |
| 4,608,971 | 9/1986 | Borschneck | 602/38 |
| 4,665,899 | 5/1987 | Farris et al. | 601/33 |
| 4,672,697 | 6/1987 | Schurch . | |
| 4,747,779 | 5/1988 | Gerstung | 128/882 |
| 4,854,138 | 8/1989 | Charland | 128/878 |
| 4,909,051 | 3/1990 | Lee | 128/878 |
| 4,936,299 | 6/1990 | Erlandson | 601/33 |
| 4,964,628 | 10/1990 | Poplawski . | |
| 4,969,452 | 11/1990 | Petrofsky et al. . | |
| 5,016,885 | 5/1991 | Quigley | 273/188 R |
| 5,069,446 | 12/1991 | Larson . | |
| 5,088,480 | 2/1992 | Wang | 602/27 |
| 5,178,160 | 1/1993 | Gracovetsky et al. . | |
| 5,230,681 | 7/1993 | Hannum et al. | 482/124 |

FOREIGN PATENT DOCUMENTS

| | | | |
|---|---|---|---|
| 3436554 | 4/1986 | Germany | 482/79 |
| 9304655 | 3/1993 | WIPO | 601/35 |

*Primary Examiner*—Richard J. Apley
*Assistant Examiner*—Jeanne M. Clark
*Attorney, Agent, or Firm*—Wolf, Greenfield & Sacks, P.C.

[57] ABSTRACT

Rehabilitation method of a patient by constraining part of an impaired limb of a patient to part of a corresponding unimpaired limb of the same patient. This is done to cause the impaired and unimpaired limbs of the patient to remain symmetrically disposed. The constrained parts of the unimpaired and impaired limbs are then moved together, relative to the trunk of the patient by the muscles of the patient. The movement may be performed repetitively in series of identical repetitions, and the movement may be repeated more than one hundred times daily. The legs of the patient may be rehabilitated in this way, and the limbs may be constrained with a rehabilitative device.

A rehabilitation device that includes a left cuff to receive a left limb of a patient, and a right cuff to receive a right limb of the same patient. The right cuff is rigidly attached to the left cuff. The cuffs include constraining surfaces to prevent longitudinal and lateral motion of the limbs with respect to the cuffs.

13 Claims, 2 Drawing Sheets

REHABILITATION METHOD

BACKGROUND OF THE INVENTION

The present invention relates to the rehabilitation of injuries to one side of the body, and more particularly to the rehabilitation of the legs of stroke victims.

Victims of stroke often sustain partial or complete loss of function of one of their legs. A physical therapist often assists such patients in recovering this function. One rehabilitative training device proposed by Wheeler in U.S. Pat. No. 4,569,336, includes a first and second foot support to secure the foot of a disabled leg of the patient and the therapist's opposite foot. A substantially vertical elongated member includes a pair of adjustable leg straps to secure the rehabilitation training device to the patient's and therapist's legs. Using this device, the therapist and patient walk in unison. Wheeler states that this allows the motion of the therapist's opposite foot and leg to reinforce the muscle and motor nerve response in the patient's non-functioning foot and leg.

Certain stretching exercises also exist to maintain the limberness of the patient's arms. In one such exercise, one arm is used to stretch the other arm.

SUMMARY OF THE INVENTION

In general, the invention features rehabilitation of a patient by constraining part of an impaired limb of a patient to part of a corresponding unimpaired limb of the same patient. This is done to cause the impaired and unimpaired limbs of the patient to remain symmetrically disposed. The constrained parts of the unimpaired and impaired limbs are then moved together, relative to the trunk of the patient by the muscles of the patient. The movement may be performed repetitively in series of identical repetitions, and the movement may be repeated more than one hundred times daily. The legs of the patient may be rehabilitated in this way, and the limbs may be constrained with a rehabilitative device.

In another general aspect, the invention features a rehabilitation device that includes a left cuff to receive a left limb of a patient, and a right cuff to receive a right limb of the same patient. The right cuff is rigidly attached to the left cuff. The cuffs include constraining surfaces to prevent longitudinal and lateral motion of the limbs with respect to the cuffs.

In preferred embodiments, the left cuff and the right cuff have a length that is longer than their diameter, where the length can be twice the diameter or more. The cuffs may include distally flared ankle portions. The left cuff may be a part of a left boot portion which includes an ankle portion and a left sole portion, and the right cuff may similarly be a part of a right boot portion which includes an ankle portion and a right sole portion. The rehabilitation device may include a closure mechanism, which may comprise a buckle or hook-and-loop fastener. Each of the cuffs may include a tongue, and a pair of fasteners mounted on the tongues. The device may also include a slide board, which can be a curved surface of the device. The right and left cuffs may be formed by part of a belt and sides of a spacer attached to the belt.

The apparatus according to the invention can be quite inexpensive to produce, and the method of the invention may be practiced without the assistance of a therapist, other than for initial training and occasional follow-up. Furthermore, the apparatus of the invention can be made lightweight and easy to transport and store, and the method and apparatus may be used outside of a clinical setting. These advantages may allow the patient to perform exercises frequently, and without the inconvenience of traveling to a rehabilitation center. Furthermore, there is some indication that the method and apparatus are more effective in restoring fine motor control than other known rehabilitation techniques.

DETAILED DESCRIPTION OF THE DRAWINGS

DESCRIPTION OF THE PREFERRED EMBODIMENT

Figure 1:
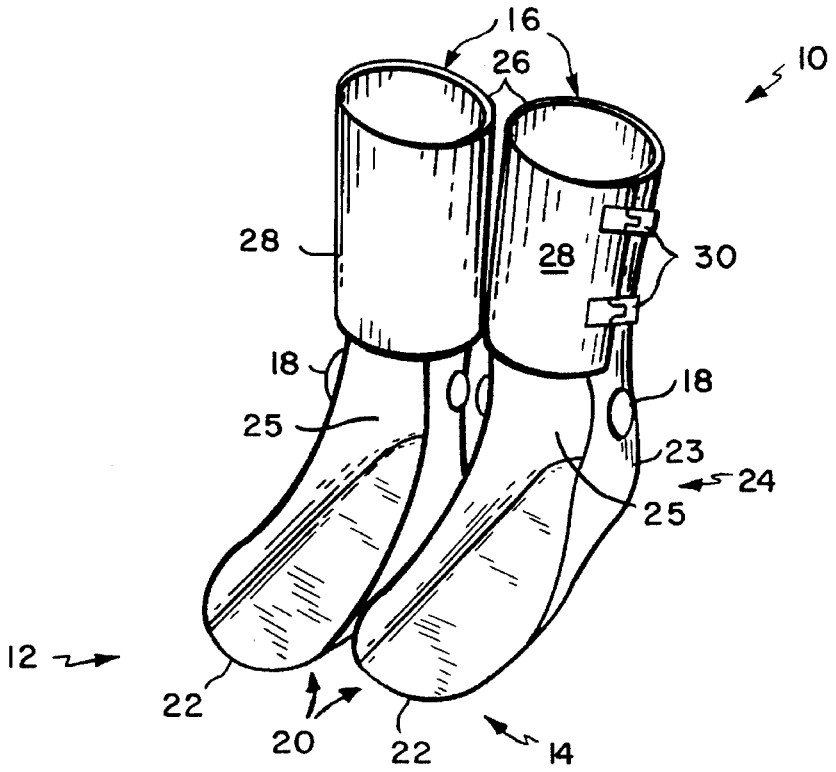
FIG. 1 is a perspective drawing of a rehabilitation device according to the invention.

Referring to FIG. 1, an exemplary rehabilitation device 10 according to the invention includes two boot portions 12 and 14. Each of these boot portions is made up of a cuff 16 and a sole 20. The cuff may include an ankle portion 18, which may be distally flared. The two boot portions may be molded as a single piece or otherwise attached in a manner to render the device generally symmetrical.

The soles 20 each include toe portions 22, and heel portions 24. The cuffs 16 each include a rear support portion 26, and a generally horizontal front tongue 28, which may be attached to the rear support portion via buckles 30. The entire assembly is preferably made of a lightweight rigid plastic, and the buckles are preferably adjustable, and may resemble those used in ski boots. The tongue may be assembled separately from the rest of the assembly and attached to the assembly (e.g., with a fastener or by welding).

The bottom surface of the heel of the sole may include an integral slide board 23. The slide board is designed to allow for sliding of the device along carpeted surfaces with relatively little friction, and to make such sliding relatively uniform. It may be made of the same material as the rest of the device, or an additional surface made of a different material with more desirable sliding characteristics may be used. It may also be shaped in a rounded manner, which allows for uniform sliding (see FIG. 2), and also holds the heel snugly.

Figure 2:
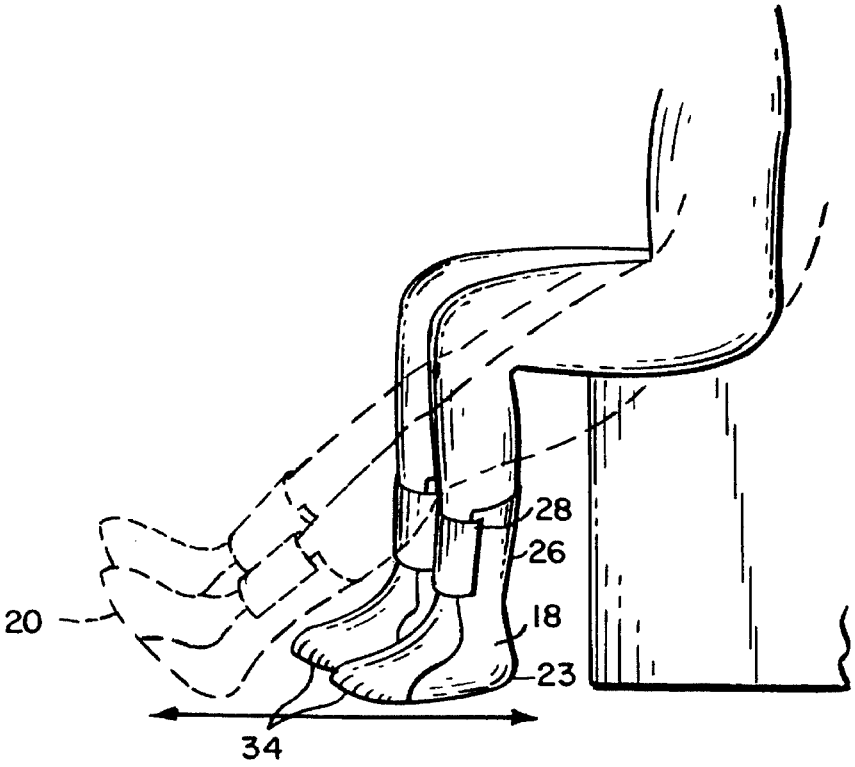
FIG. 2 is a diagrammatic perspective view of a patient using the apparatus of FIG. 1.

Referring to FIGS. 1 and 2, in operation, the patient places his or her feet on top of the sole portions 20 of the rehabilitation device 10 and rests his or her calves against the rear support portion 16. The patient closes the tongues 28 around his or her calves and secures the tongues to the rear support portions with the buckles 30. Once the device is buckled up, the patient's feet 34 are supported by the soles 20, the patient's heels are supported by the inside surface 25 of the ankle portion 18, and his/her calves are supported by the cuffs 16. This holds the patient's legs in a mirrored position.

With his or her legs constrained by the rehabilitation device 10, the patient may now use one leg to guide the other in a series of exercises. One such exercise is illustrated in FIG. 2. In this exercise, the patient uses his or her unimpaired leg to guide the other impaired leg in a sliding motion, from a seated position. During this motion, the integral side board 23 slides along the floor surface with relatively little effort.

It has been found that large numbers of repetitions of such guiding exercises of the unaffected member by the affected member can lead to significant improvements in motor function of the affected member. A large number of daily repetitions appear to be effective, such as one or more hundreds or even thousands of repetitions per day. As the exercise regimen progresses, the impaired member regains active motion and begins to more actively participate in the exercise. Once there is sufficient recovery of active motion, the patient may commence strengthening exercises. In one such exercise, the patient uses the partially recovered member to lift the weight of the unimpaired member, using the rehabilitation device to hold the two members together.

These exercises are believed to assist and promote what active motion the affected side has. It is also suspected that such exercises may promote further brain recognition of the affected side since overflow pathways are invoked as the affected and unaffected sides work in unison. The affected side appears to provide a sort of reference standard for the unaffected side to train the affected side.

The rehabilitation device 10 may hold the patient's feet in a predetermined relationship with respect to each other. This relationship may separate the feet at the toes slightly with respect to the separation at the ankles, to prevent the patient from becoming "pigeon toed". This relative separation may also be adjustable. The sole of each boot portion may also be hinged with respect to the shaft of the boot portion, at the ankle portion. This hinging allows for the ankles to be positioned at different angles in a plane roughly parallel to the patient's midsagittal plane.

Figure 3:
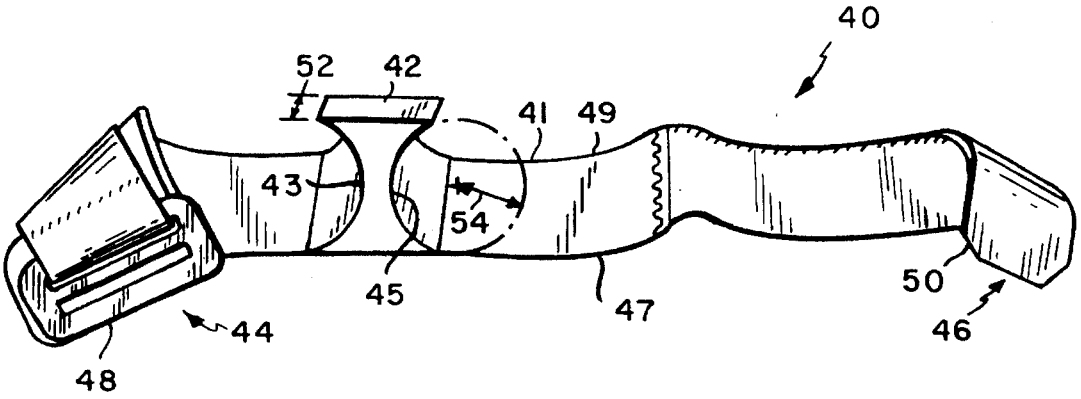
FIG. 3 is a perspective drawing of an alternative embodiment of the apparatus of the invention.

Referring to FIG. 3, a second embodiment of a rehabilitation device 40 according to the invention includes a strap 41, a spacer 42, and closure mechanism made up of first and second closure portions 44, 46. The strap may be made of cloth, leather or the like. The spacer is preferably made of a stiff foam. In one embodiment the closure portions include a buckle 48 and a hook and loop fastener (e.g., "Velcro") surface 50.

Figure 4:
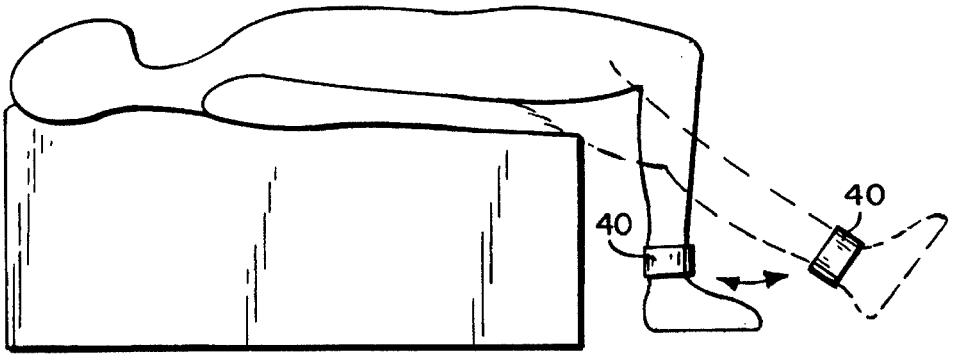
FIG. 4 is a diagrammatic plan view of a patient using the embodiment of FIG. 3.
Figure 5:
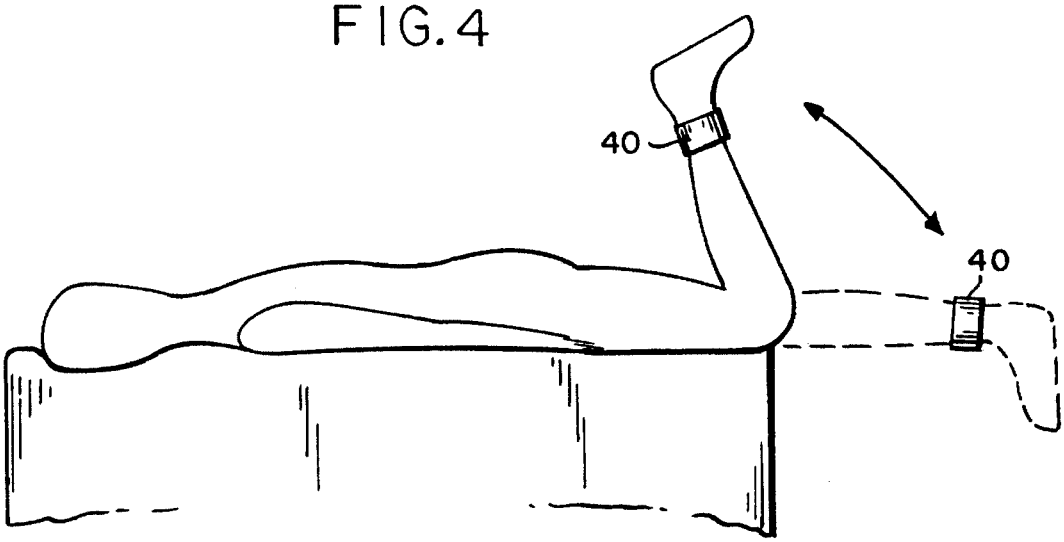
FIG. 5 is a diagrammatic plan view of a patient using the embodiment of FIG. 3 in a second manner.

Referring to FIGS. 3, 4 and 5, in using the second embodiment 40 according to the invention, the patient places his or her legs in the concave portions 43, 45 of the spacer 42, and wraps the strap 41 around them. The patient then firmly buckles the strap in place using the closure mechanism. In the buckled position, the belt and spacer cooperate to form two cuffs, which constrain the patient's legs.

Although this embodiment 40 does not include an integral slide board, and might not provide quite as much support as the first embodiment, it may be used for certain exercises. For example, as shown in FIG. 4, the patient may lay on his or her back and move his or her legs from a bent position into a straight position. Another exercise, shown in FIG. 5, is performed with the patient lying on his or her stomach and bending his or her knees from a straight position to a bent position. In these exercises, the second embodiment of the rehabilitation device of the invention serves to maintain the patient's legs in a mirrored position, such that the unaffected leg may guide and support the affected leg. Of course, these exercises may also be performed using the first embodiment of the invention.

Other exercises may also be performed by the patient with his or her legs secured by an apparatus according to the invention. Specific exercises chosen may depend on the patient's injury and/or the patient's rehabilitation objectives.

The method of the invention is also applicable to the patient's upper limbs. In the case of the upper limbs, many exercises may be performed using the second embodiment according to the invention, but a significant number of such exercises may also be performed without any rehabilitative devices. For example, the patient may use each of his or her hands to hold the opposite arm's elbow and shrug both shoulders up. The unaffected side suggests to the affected side the correct posture. Another similar exercise starts from the same position, but includes simultaneously rolling the impaired and unimpaired shoulders. Other exercises may be performed with both hands clasped together, with the unaffected upper limb guiding the affected upper limb. To achieve the objective of improvements in fine motor control, these exercises should be repeated at least 100 times daily.

It is observed that the exercises described above need not require the patient to weight bear, nor do they require the patient to exert effort to stretch his or her extremities. It is preferable, however, that the limbs be constrained to move in a mirrored fashion, so that the unaffected side may precisely train the affected side. The limbs are preferably constrained to prevent longitudinal (i.e., in the direction along the limb), and lateral (i.e., directions perpendicular to the longitudinal direction) motion.

To this end, both of the exemplary embodiments of the invention include a cuff portion that firmly constrains the patient's legs. In addition, each of these embodiments are designed to include a longitudinal constraining surface, which prevents longitudinal movement along the limbs of the patient by pressing against a part of the patient's limb with a longitudinal force component. Referring to FIGS. 1 and 3, in the first embodiment, parts of the distally flared ankle portion 18 and the slightly tapered shape of the upper part of the cuffs 16 perform this function. In the second embodiment, this function is performed by the fact that the device is placed on the legs of the patient in the narrowest part, just above the ankles, and the upper and lower edges 47, 49 of the strap 41 therefore act as a longitudinal constraining surface.

The longitudinal dimension (length) 52 of the cuff is preferably relatively long, at least longer than the diameter 54 of the cuff and even twice that long, in order to constrain the leg well (see FIG. 3). The cuff is preferably generally cylindrical, but need not be continuous along its entire length. Furthermore, other forms of closure mechanisms may be used, such as laces, latches, or the like.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A rehabilitation method, comprising:

providing a rehabilitation device including a belt portion having first and second ends, a closure mechanism constructed and adapted to fasten the first and second ends together to form a loop, and a spacer attached to the belt intermediate the first and second ends wherein the spacer forms, in cooperation with the belt when the belt forms a loop, a left cuff for receiving a left limb and a right cuff for receiving a right limb, wherein said right cuff and said left cuff have a length and a diameter and the length is longer than the diameter, positioning a portion of an impaired limb of a patient in one of the left and right cuffs, and positioning a portion of a corresponding unimpaired limb of the same patient in the other of the left and right cuffs to cause the impaired limb of the patient and the unimpaired limb of the patient to remain symmetrically disposed; and moving the unimpaired limb and the constrained portion of the impaired limb together relative to the trunk of the patient by the muscles of the unimpaired limb of patient.

2. The rehabilitation method according to claim 1, wherein said step of providing uses said spacer that defines a left concave portion and a right concave portion, said left concave portion forming a portion of the left cuff, and said right concave portion forming a portion of the right cuff.

3. The method of claim 1 wherein the step of moving is performed repetitively in series of identical repetitions.

4. The method of claim 1 wherein the step of moving is repeated more than one hundred times daily.

5. The method of claim 1 wherein the limbs are the legs of the patient.

6. A rehabilitation method, comprising:

providing a rehabilitation device including a left cuff constructed and arranged to receive a left limb of a patient, a right cuff constructed and arranged to receive a right limb of the same patient, the right cuff being rigidly attached to the left cuff in a side-by-side relationship, and wherein the cuffs include constraining surfaces constructed and disposed in a manner to prevent longitudinal and lateral motion of the right limb with respect to the right cuff and to prevent longitudinal and lateral motion of the left limb with respect to the left cuff;

positioning a portion of an impaired limb of a patient in one of the left and right cuffs, and positioning a portion of a corresponding unimpaired limb of the same patient in the other of the left and right cuffs to cause the impaired limb of the patient and the unimpaired limb of the patient to remain symmetrically disposed; and moving the unimpaired limb and the constrained portion of the impaired limb together relative to the trunk of the patient by the muscles of the unimpaired limb of the patient.

7. The rehabilitation method of claim 6 wherein the step of providing includes using left cuff and a right cuff that have a length and a diameter and the length is longer than the diameter.

8. The rehabilitation method of claim 7 wherein the step of providing includes using that the length of the left and right cuffs is at least twice the diameter of the left and right cuffs.

9. The rehabilitation method of claim 6 wherein the step of providing includes using that the left and right cuffs include distally flared ankle portions, that the left cuff is a part of a left boot which includes a left ankle portion and a left sole portion, and that the right cuff is a part of a right boot which includes a right ankle portion and a right sole portion.

10. The rehabilitation method of claim 6 further including a step of using a slide board attached to the left and right cuffs.

11. The method of claim 6 wherein the step of moving is performed repetitively in series of identical repetitions.

12. The method of claim 6 wherein the step of moving is repeated more than one hundred times daily.

13. The method of claim 6 wherein the limbs are the legs of the patient.

* * * * *